US006616781B2

(12) United States Patent
Mayle et al.

(10) Patent No.: US 6,616,781 B2
(45) **Date of Patent: *Sep. 9, 2003**

(54) OPEN DIE SYSTEM

(76) Inventors: Steven R. Mayle, 2274 Augusta Dr., Fremont, OH (US) 43420; Robert L. Mayle, 2047 S. Hyde Rd., Port Clinton, OH (US) 43452

( * ) Notice: Subject to any disclaimer, the term of this patent is extended or adjusted under 35 U.S.C. 154(b) by 0 days.

This patent is subject to a terminal disclaimer.

(21) Appl. No.: 09/901,164

(22) Filed: Jul. 9, 2001

(65) Prior Publication Data

US 2003/0005648 A1 Jan. 9, 2003

(51) Int. Cl.[7] ..... B29C 65/00

(52) U.S. Cl. ..... 156/73.5; 156/274.4; 156/275.1; 156/308.4; 156/380.5; 156/380.6; 52/48; 285/42; 425/500; 425/392

(58) Field of Search ..... 156/71, 73.5, 274.4, 156/275.1, 308.2, 308.4, 380.4, 380.5, 380.6; 52/58, 198, 219; 285/42, 43, 44; 425/500, 392

(56) References Cited

U.S. PATENT DOCUMENTS

| | | | | |
|---|---|---|---|---|
| 322,153 A | 7/1885 | Blair et al. | ..... | 52/540 |
| 549,352 A | 11/1895 | Folger | ..... | 285/43 |

(List continued on next page.)

FOREIGN PATENT DOCUMENTS

| | | |
|---|---|---|
| CH | 221530 | 6/1942 |
| DE | 3321101 | 12/1983 |
| GB | 1 310 003 | 1/1971 |
| GB | 1 355 517 | 5/1971 |
| GB | 1 511 729 | 10/1975 |
| JP | 49-002675 | 1/1974 |

OTHER PUBLICATIONS

Alkor Single Ply Roofing Systems brochure.
At Last Roofing, Inc. catalog, 1986.
Benoit E.P.D.M. Roofing Systems brochure, 1983.
Bond Cote Roofing Systems detail drawings, Jul. 1988.
Custom Seal detail drawings.
Duro–Last detail drawings, Jun. 1983.
Duro–Last Roofing, Inc. The Complete Roofing System.
Duro–Last Roofing, Inc. Factory Mutual Systems manual, mid–1980's.
Duro–Last Roofing, Inc. information manual, 1991–1994.
Duro–Last Roofing, Inc. information manual.
Duro–Last Roofing, Inc. manual, Jan. 1992.
GAF Roofing Products brochure, 1983.
GenFlex Roofing Systems detail drawings, 1994.
General Tire All Climate Roofing Systems brochure, 1982.
General Tire Building and Products Company, The General Tire and Rubber Company, Field Fabricated Pipe Boot spec sheet, Jun. 1983.
GTR Building and Products Company, The General Tire and Rubber Company, GenSeal ACR Roofing System Roof Pipe Penetration spec sheet.
GTR Building and Products Company, The General Tire and Rubber Company, Prefabricated Pipe Boot spec sheet, Jun. 1984.

(List continued on next page.)

*Primary Examiner*—Michael W. Ball
*Assistant Examiner*—John T. Haran
(74) *Attorney, Agent, or Firm*—Standley & Gilcrest LLP

(57) ABSTRACT

A die system for use in formation of a welded flashing, comprising a body portion comprised of a conducting material, the body portion having a first end and a second end; an indent portion at the first end of said body portion adapted to accept a portion of the flashing during welding; and where the portion of the flashing accepted in the indent portion of the body portion is folded away from an operational connection between the first end of the body portion and a welder during welding.

18 Claims, 5 Drawing Sheets

U.S. PATENT DOCUMENTS

| | | | | |
|---|---|---|---|---|
| 821,426 | A | 5/1906 | Meyer | 24/280 |
| 835,889 | A | 11/1906 | Moeller | 52/521 |
| 1,012,219 | A | 12/1911 | Overton | 285/44 |
| 1,031,577 | A | 7/1912 | Overton | 285/44 |
| 1,080,159 | A | 12/1913 | Overton | 285/43 |
| 1,103,666 | A | 7/1914 | Fife | 285/13 |
| 1,163,034 | A | 12/1915 | Phippen | 52/551 |
| 1,195,338 | A | 8/1916 | Churchill | 285/44 |
| 1,202,687 | A | 10/1916 | Elkerton | 285/13 |
| 1,540,192 | A | 6/1925 | Smith | 285/13 |
| 1,594,932 | A | 8/1926 | Doyle | 285/43 |
| 1,678,715 | A | 7/1928 | Stephenson | 285/44 |
| 1,721,715 | A | 7/1929 | Schindler | 285/43 |
| 1,923,220 | A | 8/1933 | Lightbown | 285/13 |
| 2,069,289 | A | 2/1937 | Swendsen et al. | 52/288.1 |
| 2,151,794 | A | 3/1939 | Peebles | 52/540 |
| 2,176,344 | A | 10/1939 | Hunt | 52/548 |
| 2,256,313 | A | 9/1941 | Dexter | 52/548 |
| 3,040,154 | A | 6/1962 | Marsh | 156/539 |
| 3,054,222 | A | 9/1962 | Buckner | 52/543 |
| 3,325,953 | A | 6/1967 | Alleaume | 52/276 |
| 3,446,685 | A | 5/1969 | Goldstone et al. | 156/219 |
| 3,446,688 | A | 5/1969 | Flax | 156/423 |
| 3,451,178 | A | 6/1969 | Beale | 52/210 |
| 3,566,562 | A | 3/1971 | White | |
| 3,763,605 | A | 10/1973 | Freeman | 52/58 |
| 3,871,145 | A | 3/1975 | Hatmaker | 52/60 |
| 3,887,323 | A | 6/1975 | Bratten | 425/521 |
| 3,890,754 | A | 6/1975 | Spurdle | 52/631 |
| 3,894,376 | A | 7/1975 | Shearer | 52/518 |
| 3,942,295 | A | 3/1976 | Schacht | 52/288 |
| 4,049,034 | A | 9/1977 | Vcelka et al. | 150/8 |
| 4,112,632 | A | 9/1978 | Simpson | 52/11 |
| 4,115,961 | A | 9/1978 | Bishop | 52/58 |
| 4,120,129 | A | 10/1978 | Nagler et al. | 52/219 |
| 4,162,597 | A | 7/1979 | Kelly | 52/410 |
| 4,192,116 | A | 3/1980 | Kelly | 52/469 |
| 4,217,742 | A | 8/1980 | Evans | 52/553 |
| 4,223,486 | A | 9/1980 | Kelly | 52/1 |
| 4,226,069 | A | 10/1980 | Hinds | 52/521 |
| 4,265,058 | A | 5/1981 | Logsdon | 52/58 |
| 4,302,275 | A | 11/1981 | Burmeister et al. | 156/446 |
| 4,335,546 | A | 6/1982 | Kelly | 52/58 |
| 4,351,140 | A | 9/1982 | Simpson | 52/542 |
| 4,374,695 | A | 2/1983 | Ikeda et al. | 156/293 |
| 4,382,353 | A | 5/1983 | Kelly | 52/506 |
| 4,386,488 | A | 6/1983 | Gibbs | 52/199 |
| 4,389,826 | A | 6/1983 | Kelly | 52/410 |
| 4,419,067 | A | 12/1983 | Graafmann | 425/392 |
| 4,441,295 | A | 4/1984 | Kelly | 52/408 |
| 4,446,665 | A | 5/1984 | Berger | 52/407 |
| 4,449,336 | A | 5/1984 | Kelly | 52/105 |
| 4,493,175 | A | 1/1985 | Coppola | 52/410 |
| 4,496,410 | A | 1/1985 | Davis et al. | 156/84 |
| 4,544,593 | A | 10/1985 | Borgert et al. | 428/80 |
| 4,555,296 | A | 11/1985 | Burtch et al. | 156/446 |
| 4,557,081 | A | 12/1985 | Kelly | 52/94 |
| 4,603,517 | A | 8/1986 | Lyons, Jr. | 52/60 |
| 4,625,469 | A | 12/1986 | Gentry et al. | 52/3 |
| 4,635,409 | A | 1/1987 | Vandemore | 52/60 |
| 4,642,950 | A | 2/1987 | Kelly | 52/90 |
| 4,652,321 | A | 3/1987 | Greko | 156/165 |
| 4,668,315 | A | 5/1987 | Brady et al. | 156/71 |
| 4,671,036 | A | 6/1987 | Sullivan | 52/518 |
| 4,688,361 | A | 8/1987 | Kelly | 52/173 R |
| 4,700,512 | A | 10/1987 | Laska | 52/58 |
| 4,712,348 | A | 12/1987 | Triplett et al. | 52/408 |
| 4,718,211 | A | 1/1988 | Russell et al. | 52/409 |
| 4,726,164 | A | 2/1988 | Reinwall et al. | 52/410 |
| 4,736,562 | A | 4/1988 | Kelly | 52/173 R |
| 4,799,986 | A | 1/1989 | Janni | 156/196 |
| 4,834,828 | A | 5/1989 | Murphy | 156/359 |
| 4,848,045 | A | 7/1989 | Nichols et al. | 52/60 |
| 4,860,514 | A | 8/1989 | Kelly | 52/410 |
| 4,870,796 | A | 10/1989 | Hart et al. | 52/409 |
| 4,872,296 | A | 10/1989 | Janni | 52/58 |
| 4,888,930 | A | 12/1989 | Kelly | 52/410 |
| 4,909,135 | A | 3/1990 | Greko | 454/368 |
| 4,947,614 | A | 8/1990 | Mayle | 52/717.1 |
| 4,963,219 | A | 10/1990 | Nichols et al. | |
| 5,014,486 | A | 5/1991 | Mayle | 52/717.1 |
| 5,027,572 | A | 7/1991 | Purcell et al. | 52/309.9 |
| 5,031,374 | A | 7/1991 | Batch et al. | 52/410 |
| 5,065,553 | A | 11/1991 | Magid | 52/58 |
| 5,077,943 | A | 1/1992 | McGady | 52/58 |
| 5,145,617 | A | 9/1992 | Hermanson et al. | 264/143 |
| 5,197,252 | A | 3/1993 | Tiscareno | 52/553 |
| 5,218,793 | A | 6/1993 | Ball | 52/62 |
| 5,365,709 | A | 11/1994 | Lassiter | 52/408 |
| 5,452,553 | A | 9/1995 | Clapp et al. | 52/408 |
| 5,570,553 | A | 11/1996 | Balkins | 52/518 |
| 5,586,414 | A | 12/1996 | Tawzer | 52/57 |
| 5,605,019 | A | 2/1997 | Maziekien et al. | 52/58 |
| 5,706,610 | A | 1/1998 | Mayle | 52/60 |
| 5,740,647 | A | 4/1998 | Kelly | 52/408 |
| 5,775,052 | A | 7/1998 | Mayle | 52/746.11 |
| 5,829,214 | A | 11/1998 | Hart | |
| 5,850,719 | A | 12/1998 | Mayle | 52/408 |
| 5,930,969 | A | 8/1999 | Mayle et al. | 52/545 |
| 5,935,357 | A | 8/1999 | Hubbard et al. | 156/82 |
| 5,983,592 | A | 11/1999 | Mayle | 52/746.11 |
| 6,004,645 | A | 12/1999 | Hubbard | 428/57 |
| 6,021,616 | A | 2/2000 | Mayle | 52/408 |
| 6,110,311 | A | 8/2000 | Mayle et al. | 156/189 |
| 6,187,122 | B1 | 2/2001 | Hubbard et al. | 156/82 |
| 6,199,326 | B1 | 3/2001 | Mayle | 52/58 |
| 6,205,730 | B1 | 3/2001 | Hasan et al. | 52/408 |
| 6,250,034 | B1 | 6/2001 | Hulsey | 52/410 |

OTHER PUBLICATIONS i.p.w. Interplastic Interoof Roofing Systems brochure.

Johns–Manville Manual for Built–Up Roof Systems brochure, 1983.

J.P. Stevens Hi–Tuff single–ply membrane roofing systems brochure.

Koppers The Roofing People brochure.

Side elevational view of Custom Seal's corner piece, Mayle, Steve.

Mule–Hide Products Co., Inc. detail drawings, Feb. 1993.

Owens–Corning Fiberglass PermaPly—R brochure, 1982.

Polyken Roofing Systems brochure.

Rubber and Plastics Company, Inc. Ingle Ply Membrane Roofing brochure.

Sarnafil detail drawings, 1984.

Sarnafil Roofing Membranes brochure.

Seal–Dry/USA, Inc. detail drawings, Jun. 1994.

Seaman Corp. Fiberlite Single Ply Roof field fabricated pipe flashing drawing, Oct. 1986.

Seaman Corp. Fiberlite Single Ply Roof, pre–formed pipe flashing drawing, Jan. 1996.

Siplast brochure.

Tamko Built–Up Roofing Systems brochure, 1983.

Trocal Roofing Systems.

WeatherGuard Single Ply Elastomeric Roofing Systems brochure.

OPEN DIE SYSTEM

BACKGROUND AND SUMMARY OF THE INVENTION

The present invention relates to an open die system for making a membrane or other flashing for providing a water-tight seal. More particularly, the open die construction allows the efficient manufacture of flashings.

Polymer coated membranes are commonly used to cover and seal roofs and other building structures. Although these roofs are generally flat, there are frequently items protruding from the surface of the roof, such as vents, ductwork, air conditioning units, and the like. It is known to construct a boot or flashing for covering and sealing a vertical protrusion (e.g., pipe) extending from a roof to be sealed. Flashings may also be used to cover and seal drain outlets, e.g., scuppers, in buildings for draining water. Flashings used to seal these type of outlets are also known as scupper flashings.

In one embodiment, the flashings are manufactured by heat welding membranes of predetermined sizes together to form the finished product. One method of making the flashings involves the use of dies configured to hold the membranes in appropriate positions for welding.

The present invention is a unique open die system that allows the formation of flashings using die portions that are relatively shorter in length than the finished flashing product. The opening in the die piece allows the body portion of the flashing to be folded down into the opening and away from the welder during the welding process. The present invention is a die for use in formation of a welded flashing, comprising:

a body portion comprised of a conducting material, the body portion having a first end and a second end; an indent portion at the first end of said body portion adapted to accept a portion of the flashing during welding; and where the portion of the flashing accepted in the indent portion of the body portion is folded away from an operational connection between the first end of the body portion and a welder during welding.

In addition to the features mentioned above, objects and advantages of the present invention will be readily apparent upon a reading of the following description.

BRIEF DESCRIPTION OF THE DRAWINGS

Novel features and advantages of the present invention, in addition to those mentioned above, will become apparent to those skilled in the art from a reading of the following detailed description in conjunction with the accompanying drawings wherein similar reference characters refer to similar parts and in which.

DETAILED DESCRIPTION OF PREFERRED EMBODIMENT(S)

The preferred system herein described is not intended to be exhaustive or to limit the invention to the precise forms disclosed. They are chosen and described to explain the principles of the invention, and the application of the method to practical uses, so that others skilled in the art may practice the invention.

Figure 1:
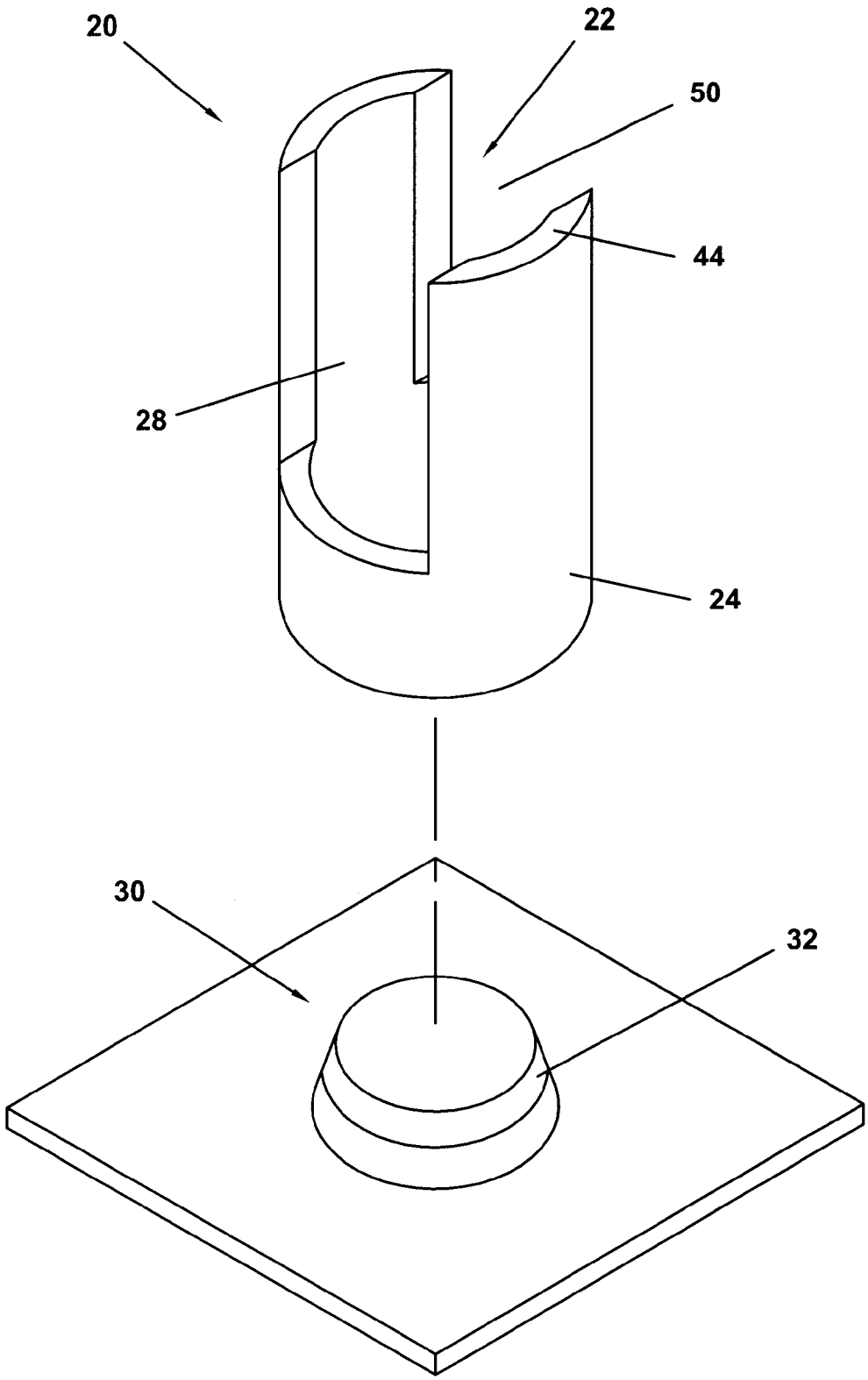
FIG. 1 illustrates an exploded view of one embodiment of the die system of the present invention.
Figure 2A:
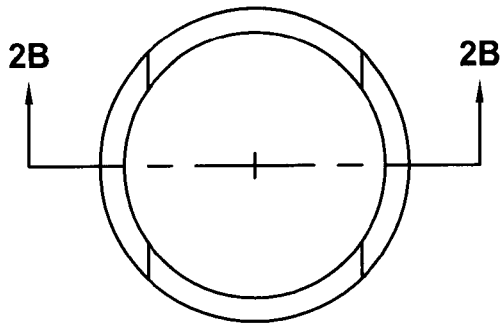
FIGS. 2A–2C illustrate various views of one embodiment of the die body portion of the present invention.
Figure 2B:
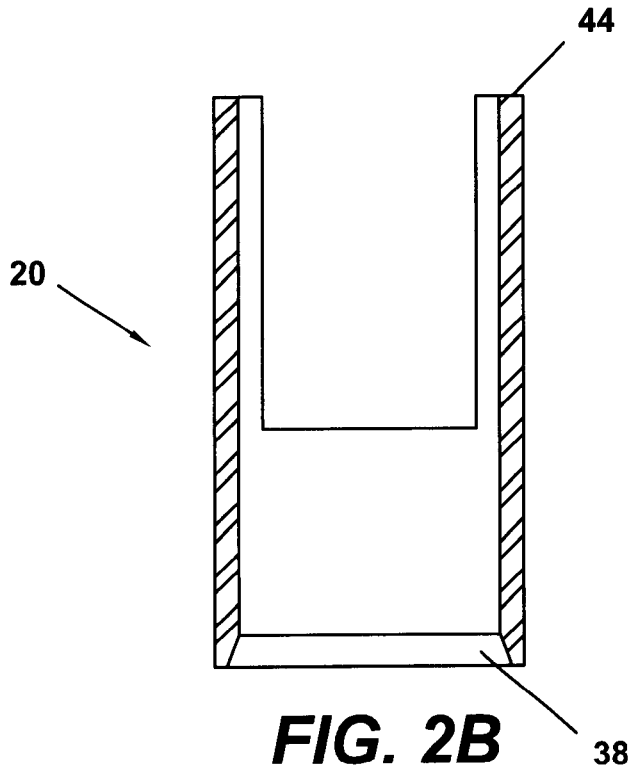
Figure 2C:
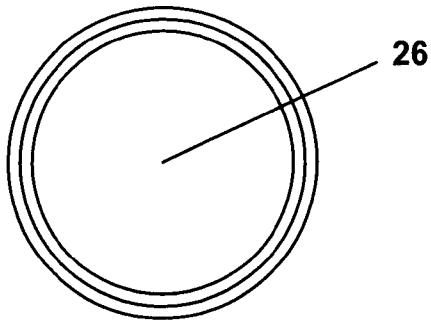
Figure 3A:
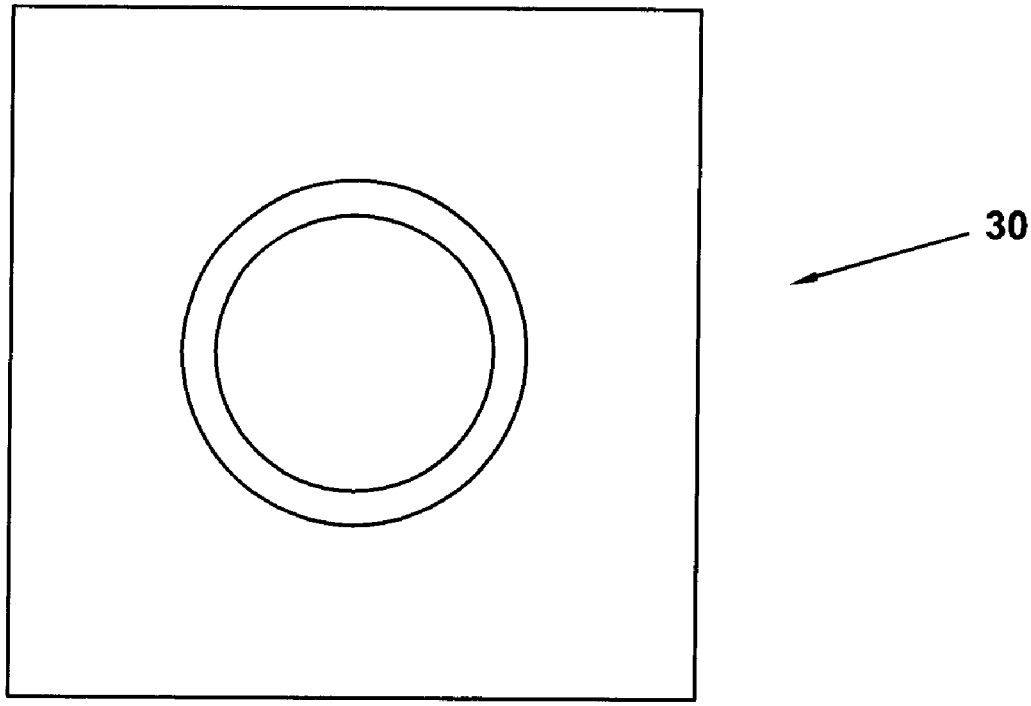
FIGS. 3A–3B illustrate a base die portion of the present invention.
Figure 3B:
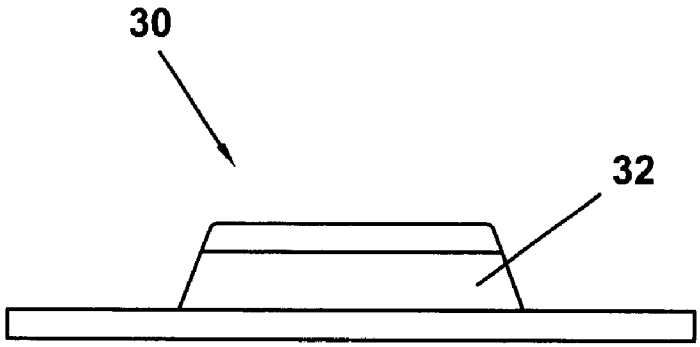

FIG. 1 illustrates an exploded view of one embodiment of the die system of the present invention; FIG. 2A illustrates a top plan view of one embodiment of the die body portion of the present invention; FIG. 2B illustrates a cross-sectional view of one embodiment of the die body portion; FIG. 2C illustrates a bottom plan view of the die body portion; FIG. 3A illustrates a top plan view of one embodiment of the base die portion of the present invention; FIG. 3B illustrates a side elevational view of the base die portion of FIG. 3A.

The die for use in formation of a welded flashing is preferably comprised of: a die body portion 20 comprised of a conducting material, the die body portion having a first end 22 and a second end 24; an opening 26 at the second end of the body portion; an indent 28 portion at the first end of the body portion adapted to accept a portion of the flashing during welding; and wherein the portion of the flashing accepted in the indent portion of the body portion is folded away from an operational connection between the first end of the die body portion and a welding machine.

The die body portion is adapted to accept a first flashing portion 29. This first flashing portion or membrane may be a conical or tubular flashing for a pipe or boot flashing, for example. The first flashing portion may be placed in the die body portion from the first or second end. The inside surface 38 of the second end of the die body portion is preferably configured to correspond to the shape of the base die member 30.

In one embodiment, the base die portion has a beveled or sloped edge 32. The base die portion may also be straight. A second flashing portion 34 having a hole 36 corresponding to the size of the base die portion is installed onto the base die portion. This second flashing portion may be a base flashing member for a boot flashing for example. The edge 40 of the second flashing along the hole is engaged to the sloped edge of the base die member. In one embodiment, the hole in the second flashing portion may be slightly smaller in diameter than the base die portion so that the hole may be stretched to accommodate, and to be held taut against, the base die portion.

The body die portion with the first flashing portion is then engaged to the base die portion with the second flashing portion installed thereto. The outside sloped surface of the base die portion is preferably mated to correspond to the inside surface of the body die portion so that the first flashing portion is pressed against the second flashing portion in the desired weld position. More particularly, a bottom edge 42 of the first flashing portion is coupled to the second flashing portion along the hole edge 40 which is engaged to the base die member during welding.

The base die portion and the body die portion are preferably comprised of a conducting material. With the first and second flashing portions engaged, and held together by the die portions, a welding machine 41 is placed into operational connection to the body die portion. In one embodiment, the welding machine connects to the first end of the die body portion; e.g., the welder covers the top of the first end of the die body portion. This operational connection to the welder is preferably made at the surface edge 44 of the first end of the die body portion. The welder is also operationally connected to the base die portion to complete the circuit. After the welder is operationally connected to the die system, heat is generated around the body die portion and the base die portion which results in a weld or sealing/joining between the first and second flashing portions held in contact by the body and base die portions.

Various known methods of heat welding may be used. In one embodiment, a radio frequency welding ("RF welding") or "RF heat sealing" machine may be used. This welding process is also known as high frequency or dielectric heat sealing. RF welding is the process of fusing materials together by applying radio frequency energy to the area to be joined. This method is designed to make use of the heat generated in poor electrical conductors, including insulators (e.g., rubber, plastics, and wood), when such materials are placed in a varying, high-frequency electromagnetic field. The heat results from electrical losses that occur in a material located between two metal plates or bars (e.g., electrodes) which form a type of capacitor connected to a radio-frequency oscillator. The metal plates or bars (electrodes) also serve to hold the materials together during heating and cooling. The electrical energy lost in the material is actually absorbed by it, causing its molecules to vibrate raising its kinetic energy or thermal energy. Unlike induction heating (i.e., preheated bars melting workpieces together), in which nonuniform heating may occur, dielectric heating makes it possible to heat an object evenly throughout thereby making a uniform weld. The degree to which this conversion of energy will occur is dependent on the atomic and molecular structure of the material and the frequency of the electromagnetic field.

The flashing portions to be welded may be made of various types of materials. In the preferred embodiment, the flashing portions are thermoplastic components, such as polyvinylchloride (PVC).

After the welder is moved, the body die portion is removed away from the base die portion and the finished welded flashing product comprised of the first and second flashing portions may be removed from the remaining die.

As discussed above, during the welding process, the welder often covers the top of the base die portion. Accordingly, a first indent 28 and a second indent 50 is placed at the first end of the body die portion to allow the first flashing portion to be folded away from the welding machine in either direction. Without these indents, the body die portion would have to be substantially the same size as the first flashing portion which is housed in the body die portion during welding. In other words, if the first flashing portion is a relatively long piece of flashing, the body die portion would also have to be a long die piece. Larger die pieces are more difficult to maneuver and are more expensive to manufacture. Accordingly, the present invention is comprised of a body die portion having at least one indent at the first end for allowing the flashing to be folded into the indent and away from the operational connection of the first end of the body die portion to the welder, e.g., welder is connected to surface edge 44 of the first end of the die body portion. In this way, the first flashing portion does not get in the way of the operational connection between the die body portion and the welder during welding.

In one embodiment, the body die portion is in a cylindrical or tubular shape. As discussed, the body die portion is adapted to house the first flashing portion during welding and wherein a top portion of the first flashing portion may be folded into said indent portion.

Figure 4A:
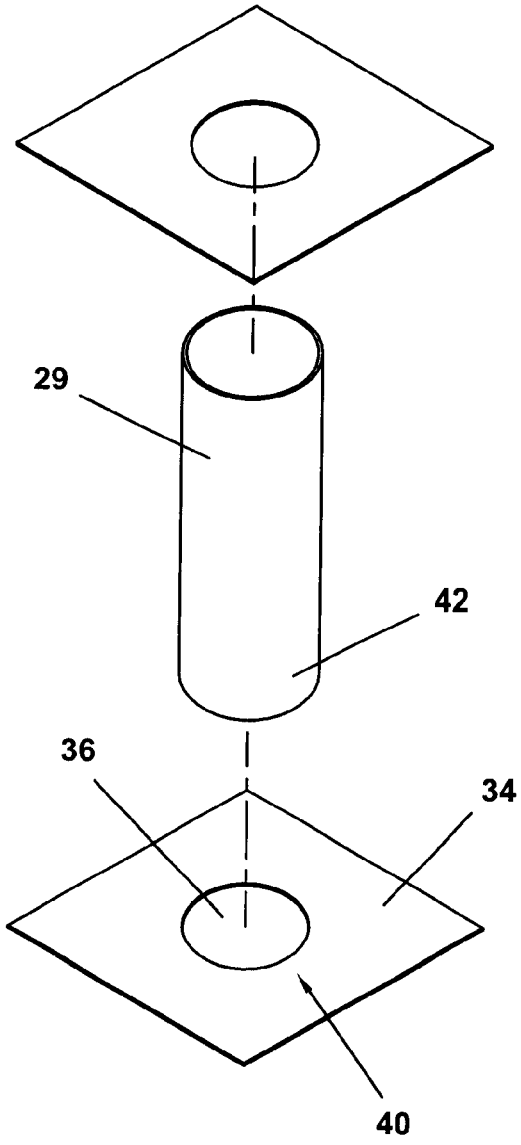
FIG. 4 illustrates one embodiment of an assembled flashing made according to the die system of the present invention.
Figure 4B:
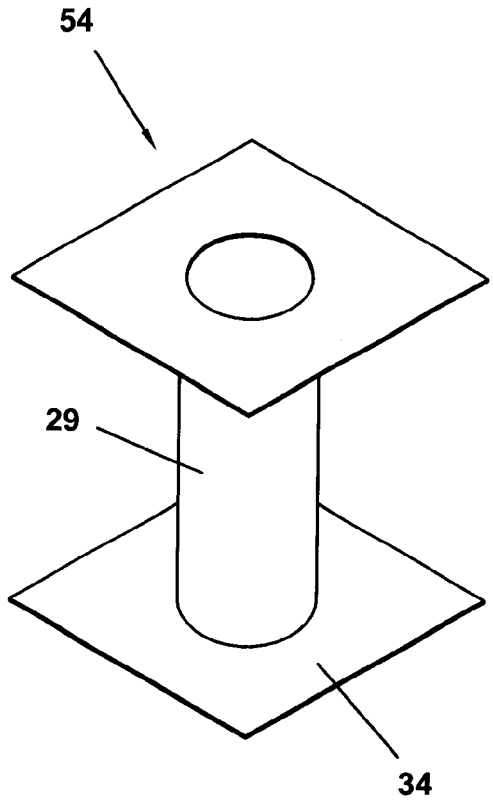
Figure 5:
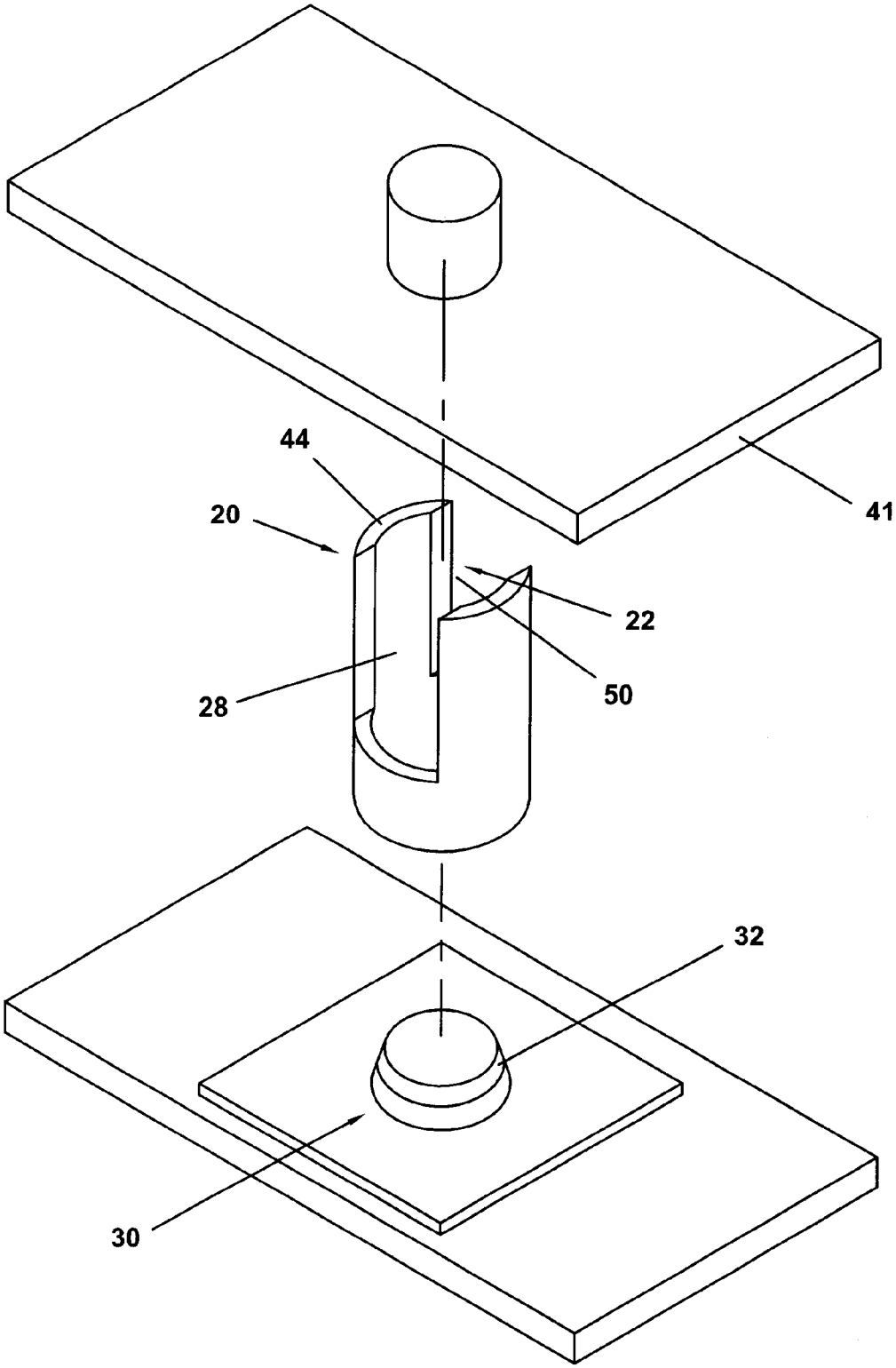
FIG. 5 illustrates one embodiment of the invention illustrating the operational connection of the welder to the die of the present invention.

In one application of the invention, the first flashing portion is a tubular flashing and the second flashing portion is a base flashing portion. The tubular flashing is housed in the body die portion during welding. The base flashing portion is installed on the base die portion during welding. The tubular flashing portion is then welded to the base flashing portion to make a boot flashing for covering projections on a roof. Another base flashing portion may be welded to other end of the tubular flashing portion to make a drain or scupper flashing product 54. See FIG. 4.

Having shown and described a preferred embodiment of the invention, those skilled in the art will realize that many variations and modifications may be made to affect the described invention and still be within the scope of the claimed invention. Thus, many of the elements indicated above may be altered or replaced by different elements which will provide the same result and fall within the spirit of the claimed invention. It is the intention, therefore, to limit the invention only as indicated by the scope of the claims.

What is claimed is:

1. A die for use in the formation of a welded flashing, comprising:

a body portion comprised of a conducting material, said body portion having a first end and a second end;

an indent portion at said first end of said body portion adapted to accept a portion of the flashing during welding; and wherein the portion of the flashing accepted in the indent portion of said body portion is folded away from an operational connection between said first end of said body portion and a welder.

2. A die according to claim 1, wherein said body portion is adapted to accept a first flashing portion.

3. A die according to claim 1 wherein said second end of said body portion is adapted for operational engagement with a base die portion.

4. A die according to claim 1, further comprising:

a second indent portion at said first end of said body portion located opposite to said indent portion, said second indent portion adapted to accept a portion of the flashing during welding.

5. A die according to claim 1, wherein the length of said die is shorter than the length of the flashing to be welded.

6. A die according to claim 1, wherein said body portion is in a cylindrical shape.

7. A die according to claim 1, wherein said second end of said body portion is adapted for operational engagement with a base die portion fitted with a second flashing portion.

8. A die according to claim 7, adapted to house the first flashing portion during welding and wherein a top portion of the flashing portion may be folded into said indent portion.

9. A die according to claim 8, adapted to hold the first flashing portion to the second flashing portion in a predetermined position when said second end of said body portion is operationally engaged to said base die portion.

10. A die according to claim 9, wherein the first flashing portion is a tubular flashing portion and the second flashing portion is a base flashing portion, said die further comprised of:

an opening at said second end of said body portion.

11. A method for welding a flashing using a open die system, comprising the steps of:

providing a welder;

providing a die body portion comprised of a conducting material, said body portion having a first end and a second end;

placing an indent portion at said first end of said die body portion adapted to accept a portion of the flashing during welding;

placing a first flashing portion to be welded into said die body portion of said die;

folding a top portion of the first flashing portion into said indent portion;

providing a second die portion;

placing a second flashing portion on said second die portion;

operationally connecting said die body portion to the second die portion so that the first flashing portion is in contact with the second flashing portion in a predetermined position;

welding the first flashing portion to the second flashing portion to form a predetermined flashing product.

12. A method according to claim 11, further comprising the steps of:

providing a sloped edge to said second die portion.

13. A method according to claim 12, further comprising the step of:

providing a sloped inner surface of said second end of said die body portion corresponding to the sloped edge of said second die portion.

14. A method according to claim 11, further comprising the step of:

providing an electromagnetic field between said die body portion and said second die portion.

15. A die system comprising:

a first die portion having a first end and second end;

an indent placed in said first end of said first die portion for receiving a portion of a flashing during welding;

a second die portion, said second end of said first die portion adapted to be placed over said second die portion during welding, said second die portion adapted to hold a second flashing portion;

wherein said first and second die portions are sized so that a first flashing portion is held in place against the second flashing portion in a predetermined weld position when said first die portion is mated with said second die portion.

16. A die system according to claim 15, wherein an inner surface of said second end of said first die portion is sloped.

17. A die system according to claim 16, wherein said second die portion is configured with a sloped exterior surface corresponding to the sloped inner surface of said first die portion.

18. A die system according to claim 15, wherein the first flashing portion is a tubular flashing portion and the second flashing portion is a flat flashing portion, the tubular flashing portion having a first end and second end and the flat flashing portion having a hole, and wherein a second end of the tubular flashing portion is welded to the flat flashing portion along the edge of the hole.

* * * * *